US006746108B1

(12) United States Patent
Jeanmaire

(10) Patent No.: US 6,746,108 B1
(45) Date of Patent: Jun. 8, 2004

(54) METHOD AND APPARATUS FOR PRINTING INK DROPLETS THAT STRIKE PRINT MEDIA SUBSTANTIALLY PERPENDICULARLY

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/298,768

(22) Filed: Nov. 18, 2002

(51) Int. Cl.[7] ..... B41J 2/105; B41J 2/09
(52) U.S. Cl. ..... 347/82; 347/77
(58) Field of Search ..... 347/73, 74, 75, 347/77, 82

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet, et al. | |
| 3,416,153 A | | 12/1968 | Hertz, et al. | |
| 3,709,432 A | | 1/1973 | Robertson | |
| 3,878,519 A | | 4/1975 | Eaton | |
| 4,070,679 A | * | 1/1978 | Fan et al. | 347/75 |
| 4,190,844 A | | 2/1980 | Taylor | |
| 4,346,387 A | | 8/1982 | Hertz | |
| 4,350,986 A | | 9/1982 | Yamada | |
| 4,638,328 A | | 1/1987 | Drake et al. | |
| 5,455,614 A | | 10/1995 | Rhodes | |
| 6,079,821 A | | 6/2000 | Chwalek et al. | |
| 6,364,470 B1 | | 4/2002 | Cabal et al. | |
| 6,474,794 B1 | | 11/2002 | Anagnostopoulos et al. | |
| 6,497,510 B1 | * | 12/2002 | Declametter et al. | 347/74 |

FOREIGN PATENT DOCUMENTS

| | | |
|---|---|---|
| EP | 0494385 A1 | 7/1992 |
| SU | 581478 | 11/1977 |
| WO | 81/03149 | 11/1981 |

OTHER PUBLICATIONS

U.S. patent application Ser. No. 09/470,638, Delametter et al., filed Dec. 22, 1999.
U.S. patent application Ser. No. 09/750,946, Jeanmaire et al., filed Dec. 28, 2000.
U.S. patent application Ser. No. 09/751,232, Jeanmaire et al., filed Dec. 28, 2000.

* cited by examiner

*Primary Examiner*—Anh T. N. Vo
(74) *Attorney, Agent, or Firm*—Stephen H. Shaw

(57) ABSTRACT

A method for printing ink droplets that strike print media substantially perpendicularly, including the steps of: emitting a first drop having a first volume and a second drop having a second volume as a stream of ink from a plurality of nozzle bores formed in a printhead; moving either the first or second drop into a perpendicular strike position relative to the print media; separating either the first drop or the second drop along different droplet paths; capturing either the first drop or the second drop with an ink gutter; and striking the print media with either the first drop or the second drop substantially perpendicular to the print media.

12 Claims, 9 Drawing Sheets

METHOD AND APPARATUS FOR PRINTING INK DROPLETS THAT STRIKE PRINT MEDIA SUBSTANTIALLY PERPENDICULARLY

CROSS REFERENCE TO RELATED APPLICATIONS

Reference is made to commonly assigned, co-pending U.S. patent application Ser. No. 09/751,232 titled "A Continuous Ink-Jet Printing Method And Apparatus," filed Dec. 28, 2000, by David L. Jeanmaire, et al., and U.S. patent application Ser. No. 09/750,946 titled "Printhead Having Gas Flow Ink Droplet Separation And Method Of Diverging Ink Droplets," filed Dec. 28, 2000, by David L. Jeanmaire, et al.; commonly assigned U.S. Pat. No. 6,474,794 titled "Incorporation Of Silicon Bridges In The Ink Channels Of CMOS/MEMS Integrated Ink Jet Print Head And Method Of Forming Same," issued Nov. 5, 2002, to Constantine N. Anagnostopoulos, et al.

FIELD OF THE INVENTION

This invention relates generally to the field of digitally controlled printing devices, and in particular to continuous inkjet printers wherein a liquid ink stream breaks into droplets, some of which are selectively deflected.

BACKGROUND OF THE INVENTION

The printing technology, commonly referred to as "continuous stream" or "continuous" inkjet printing, uses a pressurized ink source that produces a continuous stream of ink droplets. Conventional continuous inkjet printers utilize electrostatic charging devices that are placed close to the point where a filament of ink breaks into individual ink droplets. The ink droplets are electrically charged and then directed to an appropriate location by deflection electrodes. When no printing is desired, the ink droplets are directed into an ink-capturing mechanism (often referred to as a catcher, an interceptor, or a gutter). When printing is desired, the ink droplets are directed to strike a print media.

Typically, continuous inkjet printing devices are faster than drop-on-demand devices and produce higher quality printed images and graphics. However, each color printed requires an individual droplet formation, deflection, and capturing system.

U.S. Pat. No. 1,941,001, titled "Recorder," issued Dec. 26, 1933 to C. W. Hansell, and U.S. Pat. No. 3,373,437, titled "Fluid Droplet Recorder With A Plurality Of Jets," issued Mar. 12, 1968 to R. G. Sweet et al. each disclose an array of continuous inkjet nozzles wherein ink droplets to be printed are selectively charged and deflected towards the recording medium. This technique is known as binary deflection continuous inkjet printing.

U.S. Pat. No. 3,416,153, titled "Ink Jet Recorder," issued Dec. 10, 1968 to C. H. Hertz et al. discloses a method of achieving variable optical density of printed spots in continuous inkjet printing using the electrostatic dispersion of a charged droplet stream to modulate the number of droplets which pass through a small aperture.

U.S. Pat. No. 3,878,519, titled "Method And Apparatus For Synchronizing Droplet Formation In A Liquid Stream," issued Apr. 15, 1975 to James H. Eaton discloses a method and apparatus for synchronizing droplet formation in a liquid stream using electrostatic deflection by a charging tunnel and deflection plates.

U.S. Pat. No. 4,346,387, titled "Method And Apparatus For Controlling The Electric Charge On Droplets And Ink-Jet Recorder Incorporating The Same," issued Aug. 24, 1982 to Carl H. Hertz discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 4,638,382, titled "Printhead For An Ink Jet Printer," issued Jan. 20, 1987 to Donald J. Drake et al. discloses a continuous inkjet printhead that utilizes constant thermal pulses to agitate ink streams admitted through a plurality of nozzles in order to break up the ink streams into droplets at a fixed distance from the nozzles. At this point, the droplets are individually charged by a charging electrode and then deflected using deflection plates positioned in the droplet path.

As conventional continuous inkjet printers utilize electrostatic charging devices and deflector plates, they require many components and large spatial volumes to operate effectively. This results in continuous inkjet printheads and printers that are complicated, have high energy requirements, are difficult to manufacture, and are difficult to control.

U.S. Pat. No. 3,709,432, titled "Method And Apparatus For Aerodynamic Switching," issued Jan. 9, 1973 to John A. Robertson discloses a method and apparatus for stimulating a stream of ink causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air flow effects the trajectories of the filaments before they break up into droplets more than it effects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to effect the trajectory of droplets, it does rely on the precise control of the break up points of the filaments and the placement of the air flow intermediate to these break up points. Such a system is difficult to control and to manufacture. Furthermore, the physical separation or amount of discrimination between the two droplet paths is small, further adding to the difficulty of control.

U.S. Pat. No. 4,190,844, titled "Ink-let Printer With Pneumatic Deflector," issued Feb. 26, 1980 to Terrence F. E. Taylor discloses a continuous inkjet printer having a first pneumatic deflector for deflecting non-printed ink droplets to a catcher and a second pneumatic deflector for oscillating printed ink droplets. Similar arrangements are also disclosed in Soviet Union Patent No. 581478, titled "Inked Recording Of Pneumatic Signals On Paper Tape Using Pulsed Pressure Droplet Stream And Deflecting Nozzle For Signal," issued Nov. 29, 1977 and in European Patent No. 494385 issued Jul. 15, 1992 to Dietrich et al. A printhead supplies a stream of ink that breaks into individual ink droplets. The ink droplets are then selectively deflected by a first pneumatic deflector, a second pneumatic deflector, or both. The first pneumatic deflector is an "ON/OFF" type having a diaphragm that either opens or closes a nozzle depending on one of two distinct electrical signals received from a central control unit. This determines whether the ink droplet is to be printed or non-printed. The second pneumatic deflector is a continuous type having a diaphragm that varies the amount that a nozzle is open, depending on a varying electrical signal received at the central control unit. The second pneumatic deflector oscillates printed ink droplets so that characters may be printed one character at a time. If only the first pneumatic deflector is used, characters are created one line at time, and are built up by repeated traverses of the printhead.

While this method does not rely on electrostatic means to effect the trajectory of droplets, it does rely on the precise control and timing of the first ("ON/OFF") pneumatic deflector to create printed and non-printed ink droplets. Such a system is difficult to manufacture especially for high-nozzle count printheads since independent pneumatic actuators are required for each inkjet. In addition, electromechanical actuators which would be typically used to modulate the air flow have slow response times. Consequently, the printing of individual drops, according to image data, would be very slow, relative to other commercialized inkjet printheads in the current marketplace. Furthermore, the physical separation or amount of discrimination between the two droplet paths is erratic, due to the precise timing requirements; hence, increasing the difficulty of controlling printed and non-printed ink droplets and resulting in poor ink droplet trajectory control.

Additionally, using two pneumatic deflectors complicates construction of the printhead and requires more components. The additional components and complicated structure require large spatial volumes between the printhead and the media, increasing the ink droplet trajectory distance. Increasing the distance of the droplet trajectory decreases droplet placement accuracy and effects the print image quality. Again, there is a need to minimize the distance that the droplet must travel before striking the print media in order to insure high quality images.

U.S. Pat. No. 6,079,821, titled, "Continuous Ink Jet Printer With Asymmetric Heating Drop Deflection," issued Jun. 27, 2000 to James M. Chwalek et al. discloses a continuous inkjet printer that uses actuation of asymmetric heaters to create individual ink droplets from a stream of ink and to deflect those ink droplets. A printhead includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher. While the inkjet printer disclosed in U.S. Pat. No. 6,079,821 (Chawlek et al.) works extremely well for its intended purpose, it is best adapted for use with inks that have a large viscosity change associated with temperature. Each of the above-described inkjet printing systems has advantages and disadvantages. However, printheads which require low-power and low-voltages to operate are advantageous in the marketplace, especially in page-width arrays. The use of heaters to break up the ink streams into droplets has significant advantages over a piezo-transducer (as described in U.S. Pat. No. 4,350,986 titled "Ink Jet Printer," issued Sep. 21, 1982 to Takahiro Yamanda) in that the heaters can be made in a much more compact structure than the piezo-transducer type, which permits a larger density of nozzles per inch, and significantly lower manufacturing costs for the heater design. In addition, the use of heaters permits the volumes of either large or small drops to be easily adjusted and controlled, whereas droplets formed by a piezo-type vibrator are not easily adjustable and are highly dependent on the fluid properties of the ink, such as surface tension and viscosity.

U.S. Pat. No. 5,455,614 titled "Printing Method And Print Head Having Angled Ink Jet," issued Oct. 3, 1995 to Paul M. Rhodes discloses a system in which a continuous inkjet printhead assembly is angled, relative to the print substrate, such that the printing droplets follow a more perpendicular path toward the substrate. In this method, both the plane of the ink nozzle and also the plane of the deflection means are tipped to achieve the desired printing angle. This approach can be applied when the path length from the nozzle to the print media is relatively long, however, if the path length is short (for example, 3–4 mm), there would be insufficient room to angle a nozzle plate and a gas-flow deflector away from their previously used orientation, which is parallel to the print media.

International Application published under the Patent Cooperation Treaty (PCT), WO 81/03149, published Nov. 12, 1981, discloses a continuous inkjet apparatus in which electrostatic droplet deflection is used to discriminate between printing and non-printing droplets. Additionally, a second electrode structure is used to alter the path of printing drops so they strike the print media at a perpendicular angle. Good droplet placement is then achieved for printing on non-smooth or wrinkled surfaces. While this method solves the problem of non-perpendicular droplet paths, it requires that the ink droplets be charged which leads to drop-drop repulsion artifacts. In addition, the method requires high voltages and expensive control circuitry, and necessitates that the inks be within a certain conductivity range.

Referring to FIG. 1, a prior art continuous inkjet printer system 5 is shown. The prior art continuous inkjet printer system 5 includes an image source 10 such as a scanner or computer which provides raster image data, outline image data in the form of a page description language, or other forms of digital image data. This image data is converted to half-toned bitmap image data by an image processing unit 12, which also stores the image data in memory 13. A heater control circuit 14 reads data from the image memory 13 and applies electrical pulses to a heater 32 that is part of a printhead 16. These pulses are applied at an appropriate time, so that drops formed from a continuous inkjet stream will print spots on a recording medium 18 in the appropriate position designated by the data in the image memory. The printhead 16, shown in FIG. 1, is commonly referred to as a page width printhead.

Recording medium 18 is moved relative to printhead 16 by a recording medium transport system 20 which is electronically controlled by a recording medium transport control system 22, and which in turn is controlled by a microcontroller 24. The recording medium transport system 20 shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads 16, it is most convenient to move recording medium 18 past a stationary printhead 16.

Ink is contained in an ink reservoir 28 under pressure. In the nonprinting state, continuous inkjet drop streams are unable to reach recording medium 18 due to an ink gutter 34 that blocks the stream and which may allow a portion of the ink to be recycled by an ink recycling unit 36. The ink recycling unit 36 reconditions the ink and feeds it back to the ink reservoir 28. Such ink recycling units 36 are well known in the art. The ink pressure suitable for optimal operation will depend on a number of factors, including geometry and thermal properties of the nozzle bores (shown in FIG. 2) and thermal properties of the ink. A constant ink pressure can be achieved by applying pressure to ink reservoir 28 under the control of ink pressure regulator 26. System 5 can incorporate additional ink reservoirs 28 in order to accommodate color printing. When operated in this fashion, ink collected by the ink gutter 34 is typically collected and disposed.

The ink is distributed to the back surface of printhead 16 by an ink channel 30. The ink preferably flows through slots and/or holes etched through a silicon substrate of printhead 16 to its front surface where a plurality of nozzles and heaters are situated. With printhead 16 fabricated from silicon, it is possible to integrate heater control circuits 14 with the printhead. Printhead 16 can be formed using known semiconductor fabrication techniques (CMOS circuit fabrication techniques, micro-electro mechanical structure MEMS fabrication techniques, etc.). Printhead 16 can also be formed from semiconductor materials other than silicon.

Referring to FIG. 2, printhead 16 is shown in more detail. Printhead 16 includes a drop forming mechanism 38. Drop forming mechanism 38 can include a plurality of heaters 40 positioned on printhead 16 around a plurality of nozzle bores 42 formed in printhead 16. Although each heater 40 may be disposed radially away from an edge of a corresponding nozzle bore 42, heaters 40 are preferably disposed close to corresponding nozzle bores 42 in a concentric manner. Typically, heaters 40 are formed in a substantially circular or ring shape. However, heaters 40 can be formed in other shapes. Typically, each heater 40 comprises a resistive heating element 44 electrically connected to a contact pad 46 via a conductor 48. A passivation layer is normally placed over the resistive heating elements 44 and conductors 48 to provide electrical insulation relative to the ink. Contact pads 46 and conductors 48 form a portion of the heater control circuits 14 which are connected to micro-controller 24. Alternatively, other types of heaters can be used with similar results.

Heaters 40 are selectively actuated to form drops, for example, as described in U.S. patent application Ser. No. 09/751,232. The volume of the formed droplets is a function of the rate of ink flow through the nozzle and the rate of heater activation, but is independent of the amount of energy dissipated in the heaters. FIG. 3 is a schematic example of the electrical activation waveform provided by micro-controller 24 to heaters 40. In general, rapid pulsing of heaters 40 forms small ink droplets, while slower pulsing creates larger drops. In the example presented here, small ink droplets are to be used for marking the image receiver, while larger, non-printing droplets are captured for ink recycling.

In this example, multiple drops per nozzle, per image pixel are created. Periods $P_0$, $P_1$, $P_2$, etc. are the times associated with the printing of associated image pixels, the subscripts indicating the number of printing drops to be created during the pixel time. The schematic illustration shows the drops that are created as a result of the application of the various waveforms. A maximum of two small printing drops is shown for simplicity of illustration, however, the concept can be readily extended to permit a larger maximum count of printing drops.

In the drop formation for each image pixel, a non-printing large drop 95, 105, or 110 is always created, in addition to a selectable number of small, printing drops. The waveform of activation of heater 40 for every image pixel begins with electrical pulse time 65. The further (optional) activation of heater 40, after delay time 83, with an electrical pulse 70 is conducted in accordance with image data wherein at least one printing drop 100 is required as shown for interval $P_1$. For cases where the image data requires that still another printing drop be created as in interval $P_2$, heater 40 is again activated after delay 84, with a pulse 75. Heater activation electrical pulse times 65, 70, and 75 are substantially similar, as are all delay times 83 and 84. Delay times 80, 85, and 90 are the remaining times after pulsing is over in a pixel time interval P and the start of the next image pixel. All small, printing drops 100 are the same volume. However, the volume of the larger, non-printing drops 95, 105 and 110 varies depending on the number of small drops 100 created in the preceding pixel time interval P as the creation of small drops takes mass away from the large drop during the pixel time interval P. The delay time 90 is preferably chosen to be significantly larger than the delay times 83, 84 so that the volume ratio of large, non-printing drops 110 to small, printing drops 100 is a factor of about 4 or greater.

It can be seen that there is a need for improved drop placement as controlled by conventional inkjet printheads that employ a gas flow deflector for separating droplets into printing and non-printing paths. More specifically, there is a need to retain the features of low-power and low-voltage printhead operation in a continuous inkjet printhead while providing an improved printing droplet path relative to the print media.

SUMMARY OF THE INVENTION

The aforementioned need is met according to the present invention by providing a method for printing ink droplets that strike print media substantially perpendicularly, including the steps of: emitting a first drop having a first volume and a second drop having a second volume as a stream of ink from a plurality of nozzle bores formed in a printhead; moving either the first drop or the second drop into a substantially perpendicular strike position relative to the print media; separating either the first drop or the second drop along different droplet paths; capturing either the first drop or the second drop with an ink gutter; and striking the print media with either the first drop or the second drop substantially perpendicular to the print media.

Another aspect of the present invention provides an apparatus for printing an image wherein printable droplet paths are perpendicular to an image receiver, that includes: a printhead including: one or more nozzles from which streams of ink droplets of adjustable volumes are emitted; a first droplet deflector adapted to produce a force on the streams of ink droplets, the force being applied to the streams of ink droplets at an angle to cause the streams of ink droplets having a first range of volumes to move along a first set of paths, and streams of ink droplets having a second range of volumes to move along a second set of paths; a controller adapted to adjust the streams of ink droplets emitted by the one or more nozzles according to image data to be printed; an ink catcher positioned to allow the streams of ink droplets moving along the first set of paths to move unobstructed past the ink catcher, while intercepting the streams of ink droplets moving along the second sets of paths, and; a second droplet deflector which alters the flight path of the streams of ink droplets having a first range of volumes so that the flight path becomes perpendicular to the image receiver.

BRIEF DESCRIPTION OF THE DRAWINGS

Other features and advantages of the present invention will become apparent from the following description of the preferred embodiments of the invention, and the accompanying drawings, wherein.

DETAILED DESCRIPTION OF THE INVENTION

Figure 1:
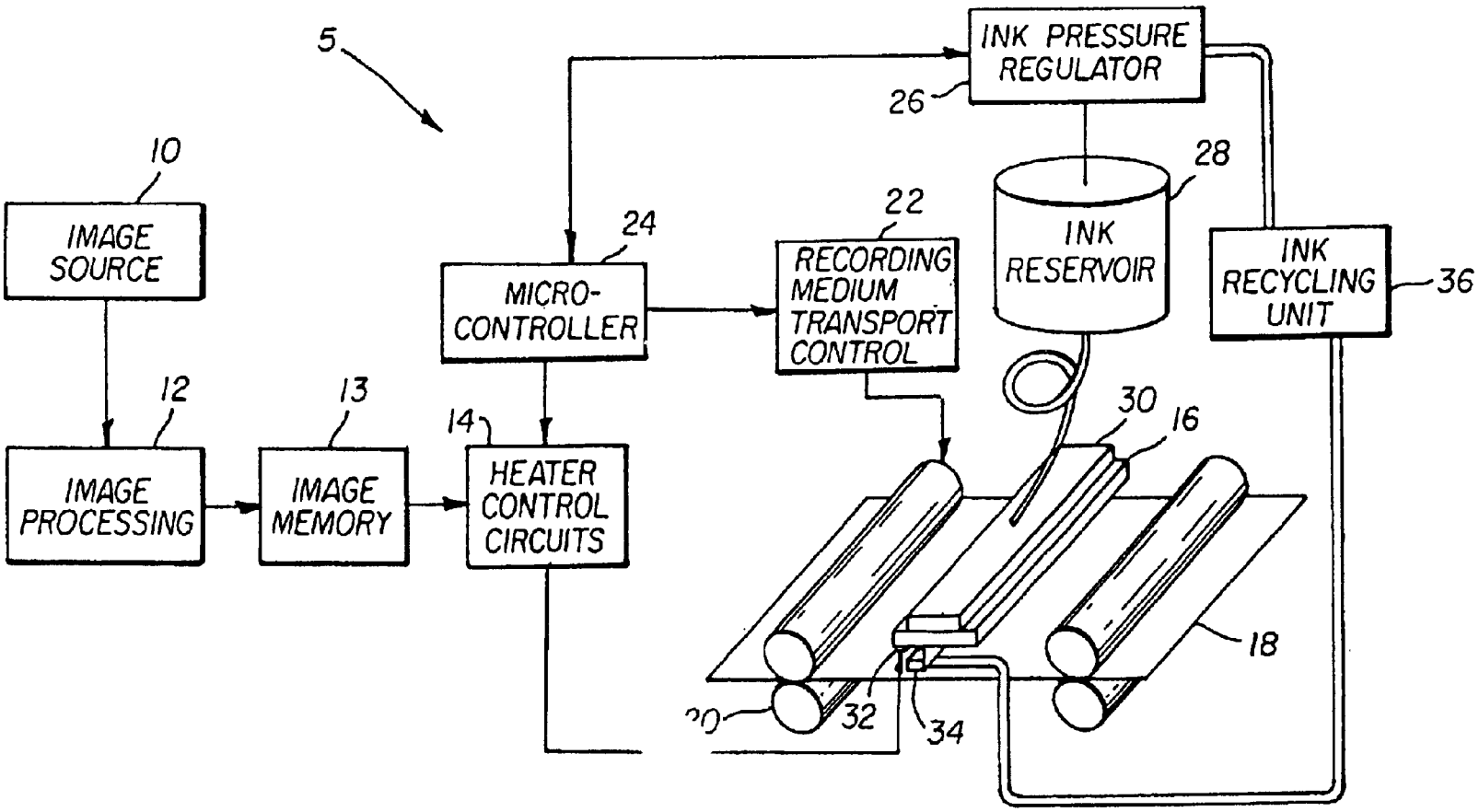
FIG. 1 (Prior Art)
FIG. 1 is a schematic diagram of a prior art continuous inkjet printer system.
Figure 2:
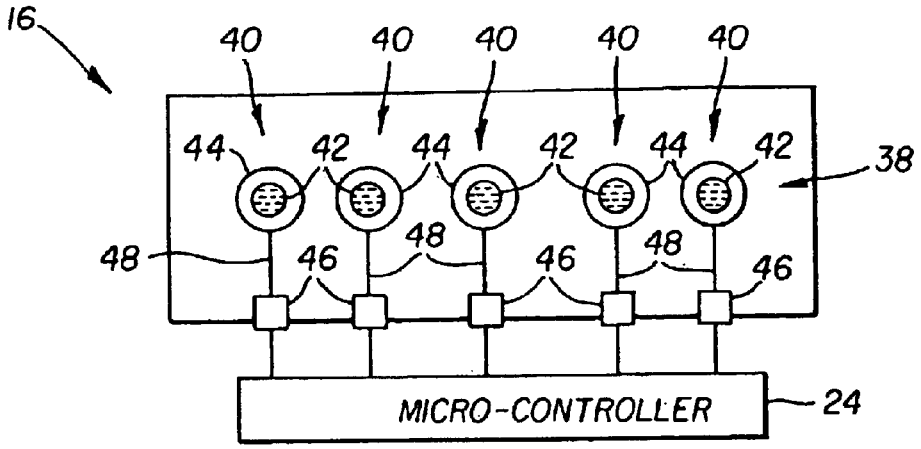
FIG. 2 (Prior Art)
FIG. 2 is a top view of a prior art printhead having a drop forming mechanism.
Figure 3:
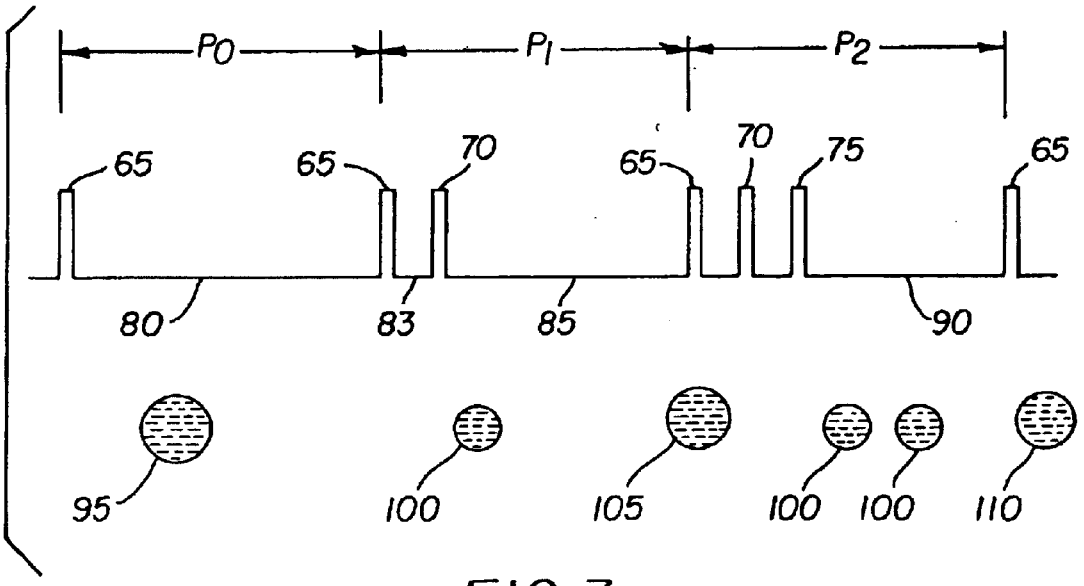
FIG. 3 (Prior Art)
FIG. 3 is a prior art diagram illustrating frequency control of a heater for an embodiment wherein smaller ink drops are used for printing.

The present invention will be directed in particular to elements forming part of, or cooperating more directly with, apparatus in accordance with the present invention. It is to be understood that elements not specifically shown or described may take various forms well known to those skilled in the art.

U.S. patent application Ser. Nos. 09/750,946 and 09/751,232, both filed in the name of David L. Jeanmaire et al. on Dec. 28, 2000, disclose continuous-jet printing, wherein nozzle heaters are selectively actuated at a plurality of frequencies to create a stream of ink droplets having a plurality of volumes. A gas stream provides a force separating droplets into printing and non-printing paths according to drop volume.

While this printing process as disclosed by Jeanmaire et al. consumes little power, and is suitable for printing with a wide range of inks, the printing droplets are deflected at angles such that their paths are not perpendicular to the surface of the print media. This creates a difficulty when the distance from the printhead to the print media changes during printing, as can occur when the print media is not held perfectly flat on the printing platen. The ink drops then do not strike the intended locations on the print media, and image quality is lost.

According to the present invention, an apparatus for printing an image, on an image receiver, comprises a printhead having a group of nozzles from which streams of ink droplets are emitted. A mechanism is associated with each nozzle and is adapted to independently adjust the volume of the ink droplets emitted by the nozzle. Generally, two ranges of drop volumes are created at a given nozzle, with the first having a substantially smaller volume than the second. A droplet deflector is adapted to produce a force on the emitted droplets, said force being applied to the droplets at an angle with respect to the stream of ink droplets to cause ink droplets having the first volumes to move along a first set of paths, and ink droplets having the second volumes to move along a second set of paths. An ink catcher is positioned to allow drops traveling along the first set of paths to move unobstructed past the catcher, while intercepting drops traveling along the second set of paths. According to the present invention, means are provided to cause the printing droplet streams to strike the print media at a perpendicular angle, while allowing the plane of the ink nozzles on the printhead to be essentially parallel to the plane of the print media. In one example of this invention, fluid-directing rib structures are used in the ink-containing region beneath the ink nozzles to cause the inkjet to be emitted at angles other than 90 degrees from the surface of the printhead. In a second example, a second gas flow provided by a second droplet deflector is used in the printing droplet path after the ink catcher to deflect the droplet flow, such that the final droplet path is perpendicular to the print media. In yet a third example, said second gas flow is created by air due to the relative motion of the print media and the printhead assembly.

Figure 4:
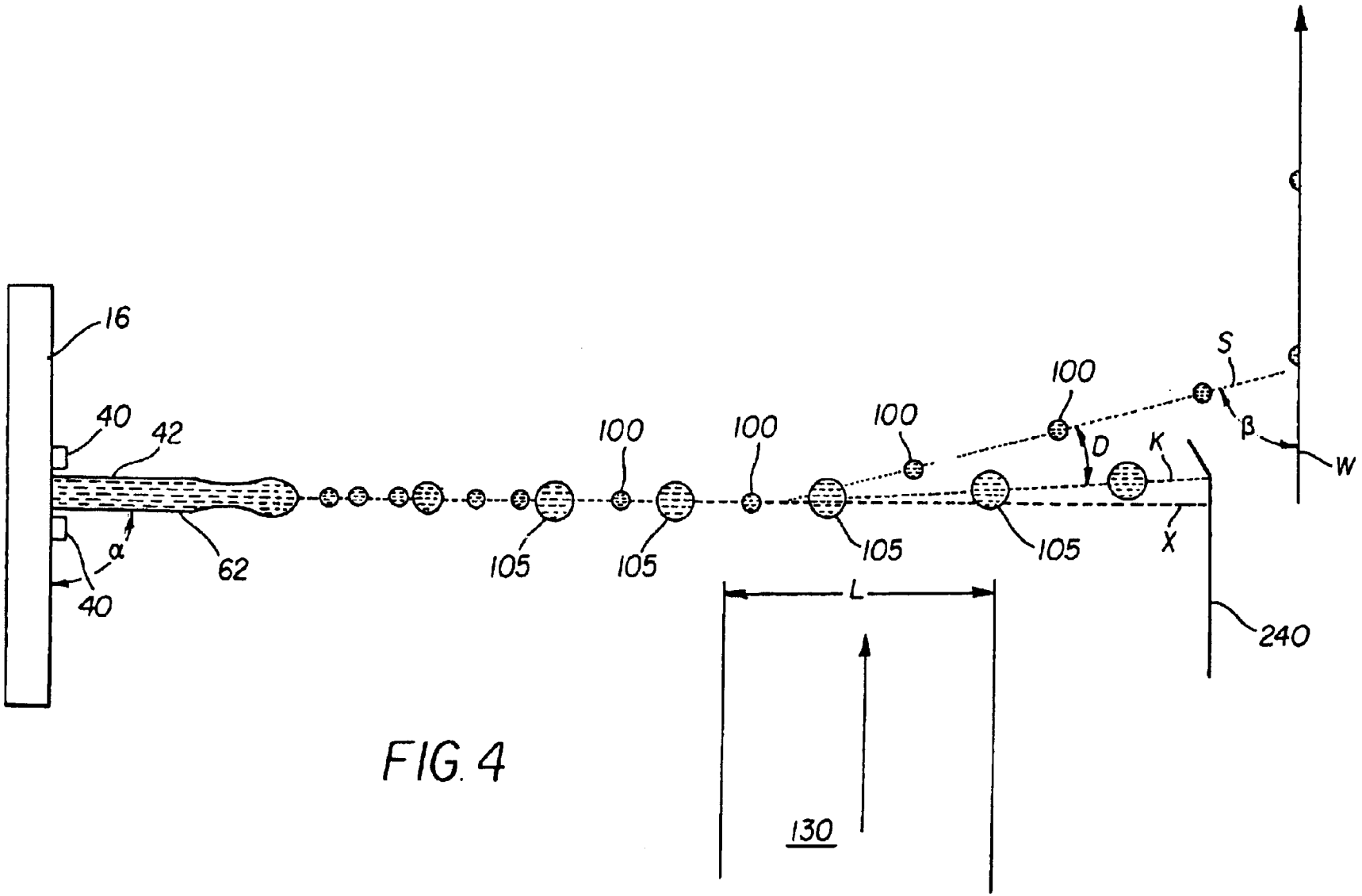
FIG. 4 is a schematic side view of a printhead having a drop forming mechanism and a drop deflector system illustrating the problem to be solved.

Referring to FIG. 4 as a schematic example of the problem to be solved, printhead 16 is operated in a manner such as to provide one printing drop per pixel, as described above. A gas flow discriminator 130 then separates droplets into printing or non-printing paths according to drop volume. Ink is ejected through nozzles 42 in printhead 16, creating a stream of ink 62 moving substantially perpendicular to printhead 16 ($\alpha$=90°) along axis X. Heaters 40 are selectively activated at various frequencies according to image data, causing the stream of ink 62 to break up into streams of individual ink droplets. Coalescence of drops often occurs in forming non-printing drops 105. A gas flow discriminator 130 is provided by a gas flow at a non-zero angle with respect to axis X and forms a first droplet deflector. For example, the gas flow may be perpendicular to axis X. Gas flow discriminator 130 acts over distance L, and as a gas force from discriminator 130 interacts with the stream of ink droplets, the individual ink droplets separate, depending on individual volume and mass. The gas flow rate can be adjusted to provide sufficient deviation D between the small droplet path S and the large droplet paths K, thereby permitting small drops 100 to strike print media W at angle $\beta$, while large, non-printing drops 105 are captured by an ink guttering structure 240. For practical values of deviation D, angle $\beta$ is not 90° and is more typically 60°–80°. Consequently, when the distance from the printhead to print media W varies during printing, drop placement errors occur, with smaller values of angle $\beta$ generally giving rise to larger placement errors. Print media W can include an image receiver.

In a first example of the present invention, the angle $\alpha$ of the inkjet relative to the plane of the nozzles (see FIG. 4) is caused to be different than 90°. Ink droplet paths X, K, and S are consequently altered so that path S becomes perpendicular to print media W ($\beta$=90°). Tipping of the jet allows the plane of the nozzles (in this example the front surface of the printhead), gas flow discriminator 130, ink gutter 240 and print media W to be parallel structures, so that the overall printhead assembly can be as compact as possible, thereby minimizing the distance from printhead 16 to print media W.

Tipping a stream of ink 62 relative to the nozzle plane may be accomplished in several manners. One is to use asymmetric heating around each nozzle as disclosed in U.S. Pat. No. 6,079,821 (Chwalek et al.) A related method for thermal deflection of the jet is described in U.S. patent application Ser. No. 09/470,638 titled "Deflection Enhancement For Continuous Ink Jet Printers," filed Dec. 22, 1999 by Christopher Delametter et al. which involves a combination of asymmetric heating and physical structures in the ink channel adjacent to the printhead nozzles. The use of asymmetric heating, however, is not preferred due to the high temperatures involved to obtain significant jet deflection.

Figure 5:
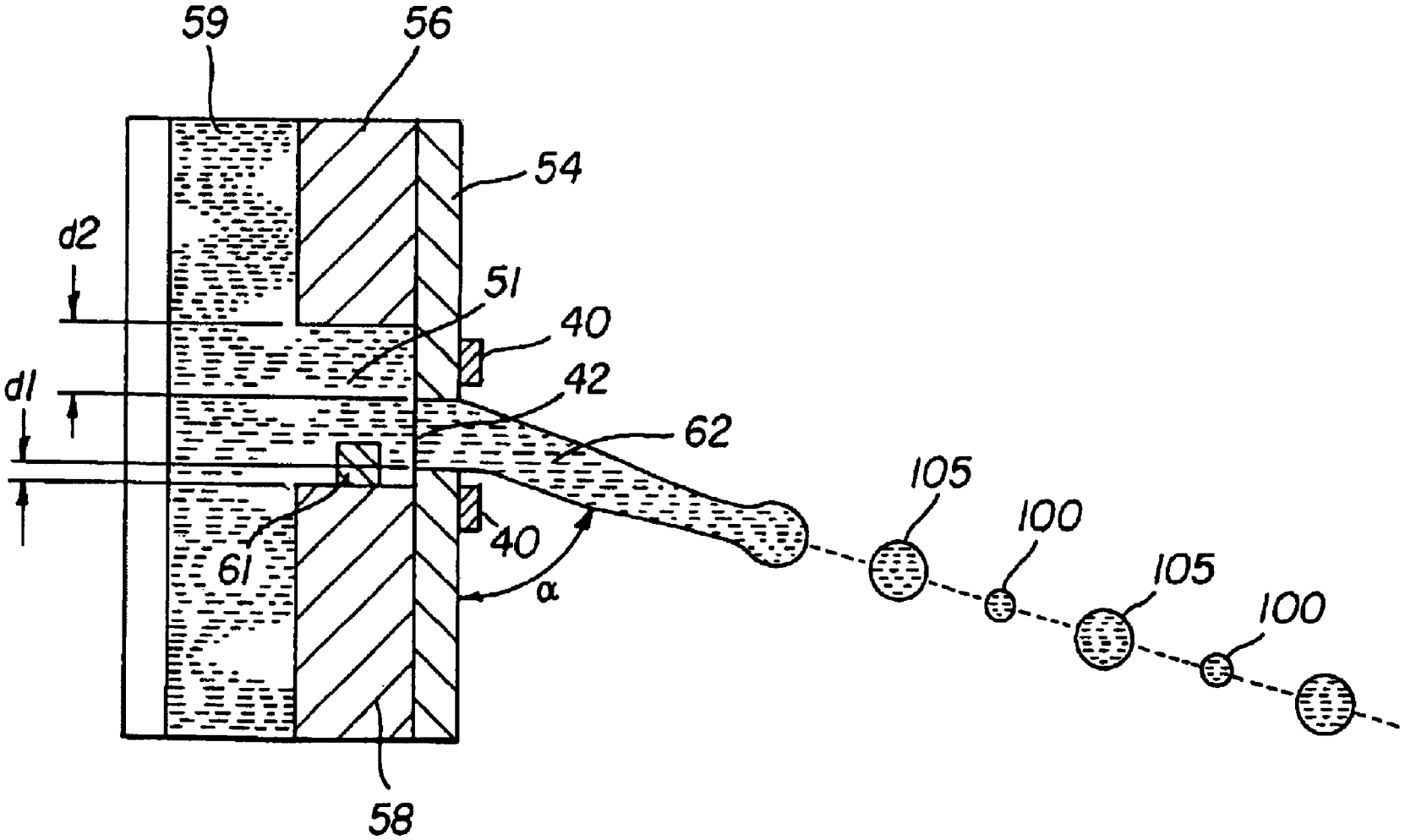
FIG. 5 is a schematic side view of a printhead having a drop forming mechanism and a drop deflector system in which a first example of the present invention is shown for printing with small ink drops.

A second approach to tipping the stream of ink 62 is to use an asymmetric physical structure in the nozzle, or in the immediate vicinity of the nozzle. One example is to use a notch structure in the nozzle bore as presented in U.S. Pat. No. 6,364,470, titled "Continuous Ink Jet Printer With A Notch Deflector," issued Apr. 2, 2002 to Antonio Cabal et al. Another approach is to provide an asymmetric ink supply channel to the nozzle as shown schematically in FIG. 5. Such an ink supply channel can be fabricated from silicon as taught in U.S. Pat. No. 6,474,794 (Anagnostopoulos). Silicon "rib" or barrier structures 56 and 58 form an ink channel 51 which supplies ink to nozzle bore 42. The barrier structures 56 and 58 may be bonded to a nozzle membrane 54, and may also be constructed of metal or silicon nitride. There may also be physical asymmetry corresponding to barrier structures 56 and 58. In one example, lower structure 58 is closer to the edge of nozzle bore 42, the measure of which is indicated by d1, than is structure 56, which is separated by distance d2 from the edge of nozzle bore 42. However, distances d1 and d2 may be reversed in another example. In yet another example, an ink manifold obstruction 61 within an ink manifold 59 directs the stream of ink into a perpendicular strike position relative to the print media W. The placement of structures 56 and 58 and/or inclusion of ink manifold obstruction 61 causes the stream of ink 62 to be jetted from nozzle bore 42 at an angle $\alpha$ which is less than 90° with respect to nozzle membrane 54. The angle $\alpha$ may be in the range of 2°–45°.

Figure 6:
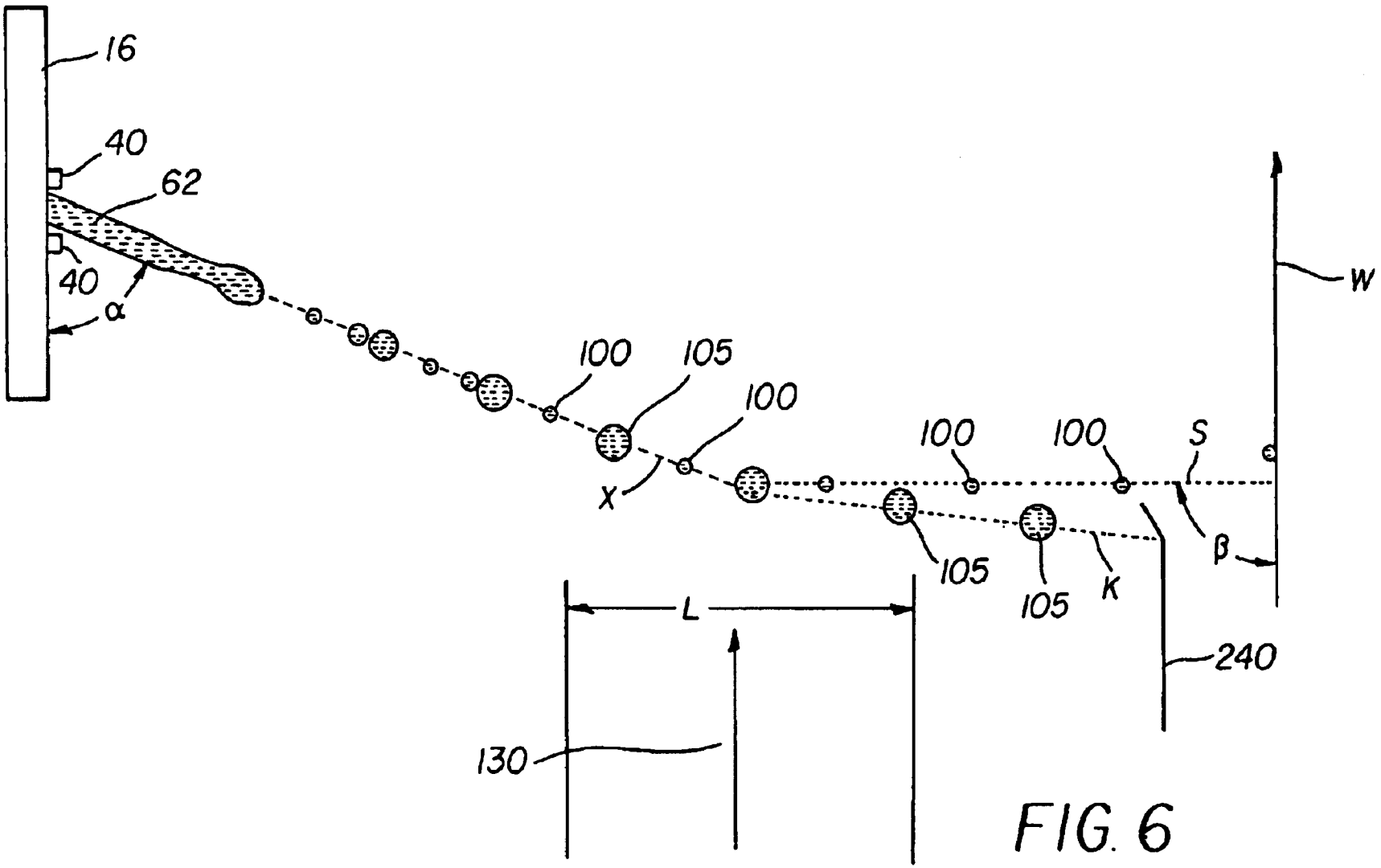
FIG. 6 is a schematic side view of a printhead having a drop forming mechanism and a drop deflector system in which a first example of the present invention is shown for printing with large ink drops.

Referring to FIG. 6 as a schematic of a printhead assembly which contains this first example of the present invention, heaters 40 on printhead 16 function to break up the stream of ink 62 into large, non-printable drops 105 and small, printable drops 100 which travel initially along path X. Gas flow discriminator 130 acts to separate large and small droplets, with small printing droplets 100 being deflected along path S and large non-printing droplets 105 along path K. Ink catcher 240 intercepts droplets moving along path K, while allowing droplets moving along path S to strike print media W at a perpendicular angle ($\beta$=90°).

Figure 7:
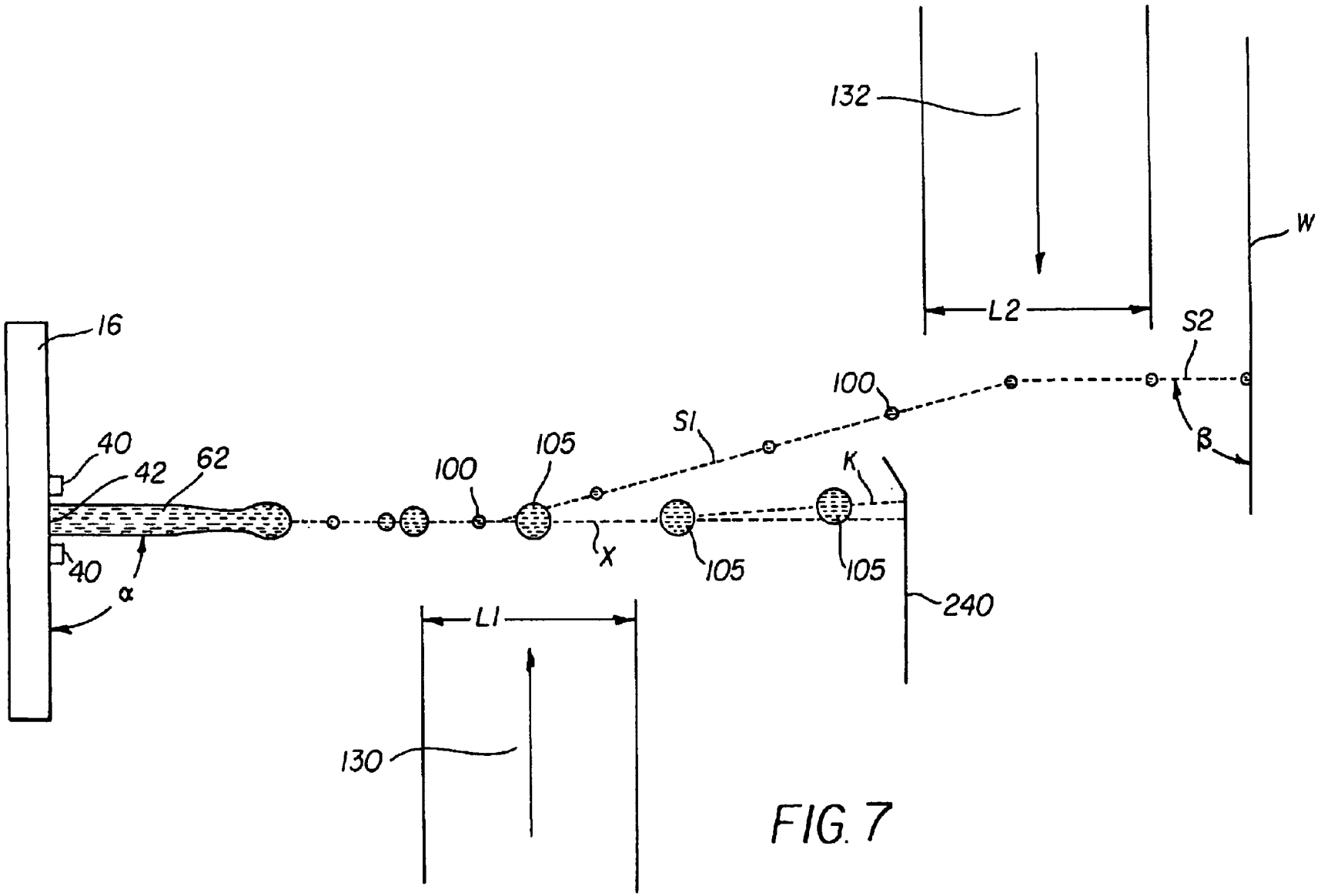
FIG. 7 is a schematic side view of a printhead having a drop forming mechanism and a drop deflector system in which a second example of the present invention is shown for printing with small ink drops.

In a second example of the present invention, a second gas flow 132 (i.e., a second droplet deflector) is used to provide a correction to the path of the small printing drops so they strike the print media at a perpendicular angle. An example of a printing apparatus which features this example is given in the schematic drawing of FIG. 7. Ink is ejected through nozzle bores 42 in printhead 16, creating a stream of ink 62 moving substantially perpendicular to printhead 16 ($\alpha$=90°) along axis X. Heaters 40 are selectively activated at various frequencies according to image data, causing a stream of ink 62 to break up into streams of individual ink droplets. A gas flow discriminator 130 is provided by a gas flow at a perpendicular angle with respect to axis X. Gas flow discriminator 130 acts over distance L1, and as gas force from gas flow discriminator 130 interacts with the stream of ink droplets, the individual ink droplets separate, depending on individual volume and mass. Small, printable drops 100 are thereby deflected along path S1, and large, non-printable drops 105 are deflected to a lesser extent along path K. The large drops 105 are captured by an ink guttering structure 240, while small drops 100 clear guttering structure 240 and interact with gas force 132, the second droplet deflector. This force is applied in a direction opposite to gas flow discriminator 130 and over a distance L2. As a result, the small drops 100 are directed onto a new droplet path S2 and strike print media W at angle $\beta$, which is essentially 90° The angle $\beta$ may be in the range of (88°–92°). Additionally, the magnitude of gas force 132 may be variable for bi-directional printing to compensate for unwanted air disturbances. The print media W moves slowly or not at all relative to the printhead.

A third example of the present invention takes advantage of the relative motion between the printhead assembly and the print media to provide a second air flow for correcting the path of printing droplets. This embodiment is shown in the schematic of a printhead assembly in FIG. 8. As in previous examples, ink is ejected through nozzle bores 42 in printhead 16, creating a stream of ink 62 moving substantially perpendicular to printhead 16 ($\alpha$=90°) along axis X. Heaters 40 are selectively activated at various frequencies according to image data, causing a stream of ink 62 to break up into streams of individual ink droplets. A gas flow discriminator 130 is provided by a gas flow at a perpendicular angle with respect to axis X. Gas flow discriminator 130 acts over distance L1, and as gas force from gas flow discriminator 130 interacts with the stream of ink droplets, the individual ink droplets separate, depending on individual volume and mass. Small, printable drops 100 are thereby deflected along path S1, and large, non-printable drops 105 are deflected to a lesser extent along path K. The large, non-printable drops 105 are captured by an ink guttering structure 24C, while small, printable drops 100 clear guttering structure 240 and interact with air force 134 which provides the second droplet deflector. Air force 134 is created by air flow due to the relative motion of the printhead assembly and the print media at high printing speeds. (For example, it is envisioned that this embodiment would find greatest utility for printer designs where printing speeds are 1 m/s and higher.) The air force 134 due to air motion acts in a direction opposite to gas flow discriminator 130 and over a distance L2. As a result, the small, printable drops 100 are directed onto a new droplet path S2 and strike print media W at angle $\beta$, which is essentially 90°. The angle $\beta$ may be in the range of 88°–92°.

Figure 8:
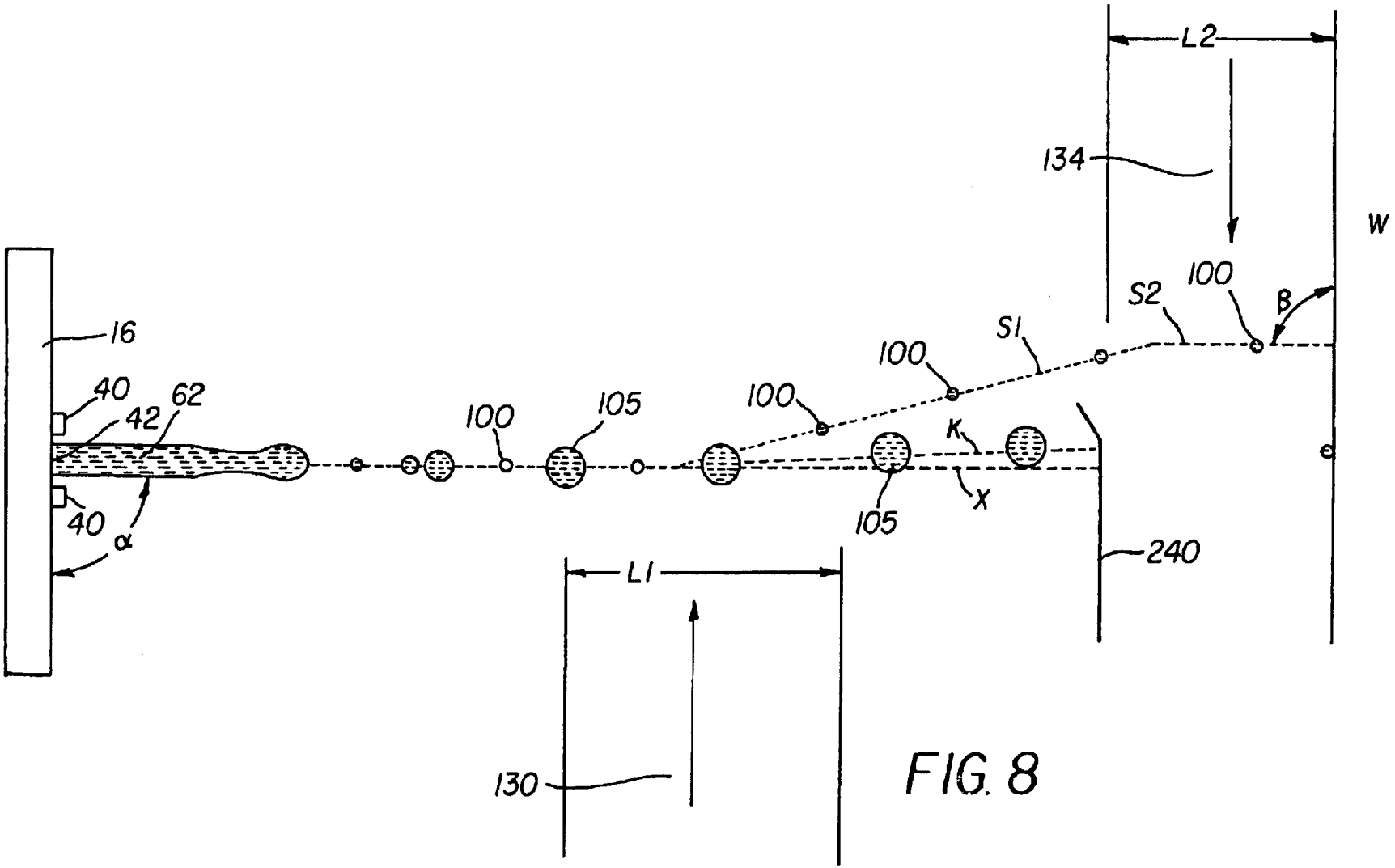
FIG. 8 is a schematic side view of a printhead having a drop forming mechanism and a drop deflector system in which a third example of the present invention is shown for printing with small ink drops.
Figure 9A:
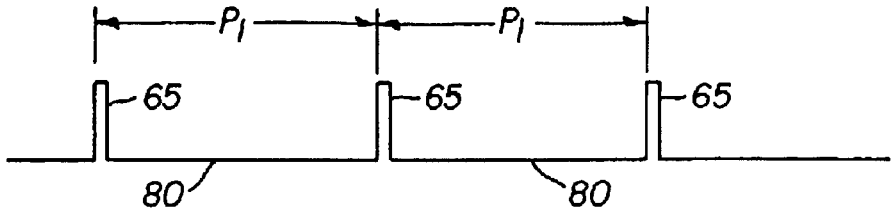
FIG. 9 is a diagram illustrating frequency control of a heater for an embodiment wherein large ink drops are used for printing.
Figure 9B:
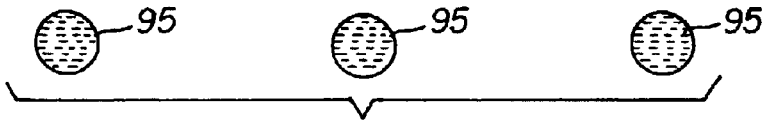
Figure 9C:
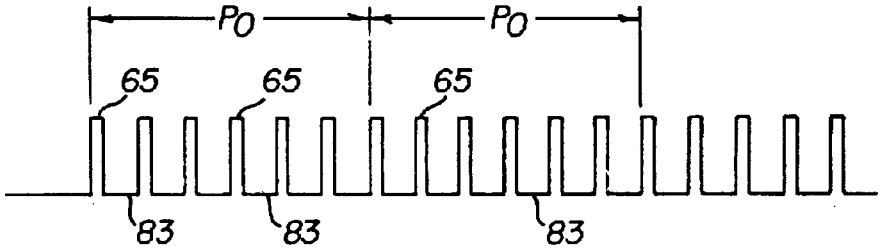
Figure 9D:
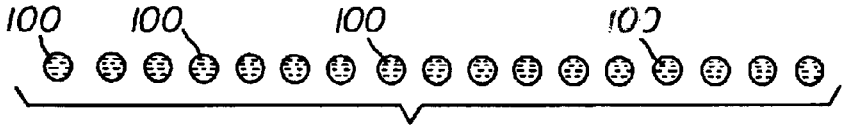

All three examples of this invention may be applied to the design of a printing apparatus wherein large droplets are used for printing, rather than small droplets. An example adapted for large droplet printing is presented here using the second example of this invention, as shown in FIG. 8. In this example, only one printing drop is provided for per image pixel, thus there are two states of heater 40 actuation, printing or non-printing. The electrical waveform of the heater 40 actuation for the printing case is presented schematically as FIG. 9*a*. The individual large, non-printable ink drops 95 resulting from the jetting of ink from nozzle bores 42, shown in FIGS. 7 and 8, in combination with this heater actuation 65 (electrical pulse time) and delay times 80, are shown schematically in FIG. 9*b*. The electrical waveform of the heater 40 activation for the non-printing case is given schematically as FIG. 9*c*. Electrical pulse 65 duration remains unchanged from FIG. 9*a*, however, time delay 83 between activation pulses is a factor of 4 shorter than delay time 80. The small, printable drops 100, as diagrammed in FIG. 9*d*, are the result of the activation of heater 40 with this non-printing waveform.

Figure 9E:
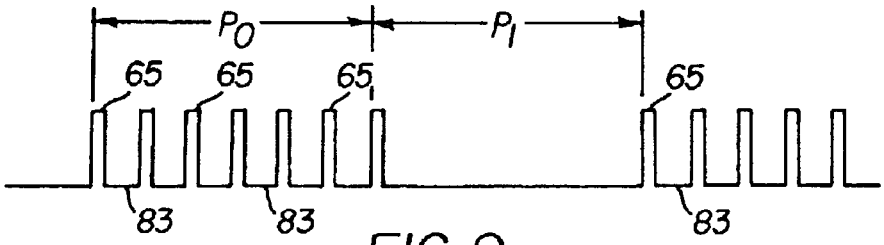
Figure 9F:
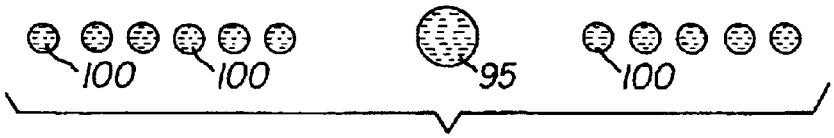

FIG. 9*e* is a schematic representation of the electrical waveform of the heater 40 activation for mixed image data where a transition is shown occurring for the non-printing state, to the printing state, and back to the non-printing state. Schematic representation FIG. 9*f* is the resultant droplet stream formed. It is apparent that the heater 40 activation may be controlled independently based on the ink color required and ejected through corresponding nozzle bore 42, movement of printhead 16 relative to a print media W, and the desired printed image.

Figure 10:
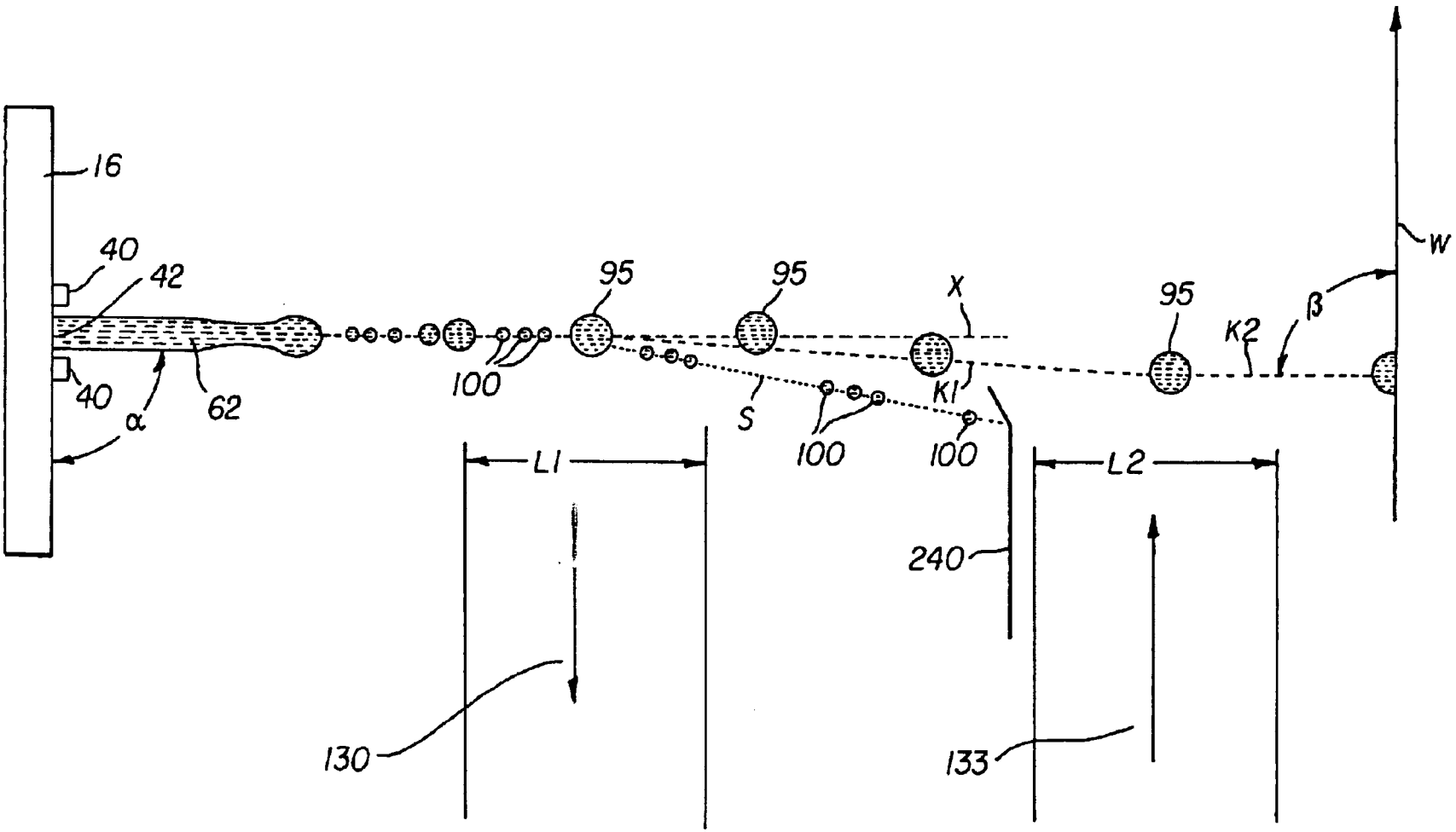
FIG. 10 is a schematic side view of a printhead having a drop forming mechanism and a drop deflector system in which a second example of the present invention is shown for printing with large ink drops.

Referring now to FIG. 10, which is a schematic representation of a printhead assembly, ink is ejected through nozzle bores 42 in printhead 16, creating a stream of ink 62 moving substantially perpendicular to printhead 16 ($\alpha$=90°) along axis X. Heaters 40 are selectively activated at various frequencies according to image data, as described in FIGS. 9*a*–9*f*, causing the streams of ink 62 to break up into streams of individual ink droplets. Coalescence of drops often occurs when forming the large, non-printable drops 95. A gas flow discriminator 130 is provided by a gas flow at a perpendicular angle with respect to axis X. Gas flow discriminator 130 acts over distance L1, and as gas force from discriminator 130 interacts with the stream of ink droplets, the individual ink droplets separate, depending on individual volume and mass. Small, printable drops 100 are thereby deflected along path S, and large, non-printable drops 95 are deflected to a lesser extent along path K1. The small, printable drops 100 are captured by an ink guttering structure 240, while large, non-printable drops 95 clear guttering structure 240 and interact with a second gas force 133. This second gas force 133 is applied in a direction opposite to gas flow discriminator 130 and over a distance L2. As a result, the large, non-printable drops 95 are directed onto a new droplet path K2 and strike print media W at angle $\beta$, which is essentially 90°.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

PARTS LIST:

| | |
|---|---|
| 5 | prior art continuous inkjet printer system |
| 10 | image source |
| 12 | image processing unit |
| 13 | memory |
| 14 | heater control circuit |
| 16 | printhead |
| 18 | recording medium |
| 20 | recording medium transport system |
| 22 | recording medium transport control system |
| 24 | micro-controller |
| 26 | ink pressure regulator |

-continued

PARTS LIST:

| | |
|---|---|
| 28 | ink reservoir |
| 30 | ink channel |
| 32 | heater |
| 34 | ink gutter |
| 36 | heat recycling unit |
| 38 | drop forming mechanism |
| 40 | heaters |
| 42 | nozzle bore |
| 44 | resistive heating element |
| 46 | contact pad |
| 48 | conductor |
| 51 | ink channel |
| 54 | nozzle membrane |
| 56 | barrier structure |
| 58 | barrier structure |
| 59 | ink manifold |
| 61 | ink manifold obstruction |
| 62 | stream of ink |
| 65 | electrical pulse time |
| 70 | electrical pulse time |
| 75 | electrical pulse time |
| 80 | delay time |
| 83 | delay time |
| 84 | delay time |
| 85 | delay time |
| 90 | delay time |
| 95 | non-printable drop |
| 100 | printable drop |
| 105 | non-printable drop |
| 110 | non-printable drop |
| 130 | gas flow discriminator |
| 132 | gas force |
| 133 | second gas force |
| 134 | air force |
| 240 | ink gutter |

What is claimed is:

1. A method for printing ink droplets that strike print media substantially perpendicularly, comprising the steps of:

a) emitting a first ink droplet having a first volume and a second ink droplet having a second volume as a stream of ink from a plurality of nozzle bores formed in a printhead;

b) applying a continuous air flow, produced from a first droplet deflector, to the stream of ink at an angle to cause the stream of ink to separate into a first stream of ink droplets having a first range of volumes, moving alone a first set of paths; and a second stream of ink droplets having a second range of volumes, moving along a second set of paths;

c) altering the first set of paths of the first stream of ink droplets having a first range of volumes with a second droplet deflector so that the first set of paths becomes perpendicular to an image receiver;

d) capturing either the first ink droplet or the second ink droplet with an ink gutter;

e) adjusting the stream of ink emitted by the one or more nozzles according to image data to be printed; and f) striking the print media with either the first ink droplet or the second ink droplet substantially perpendicular to the print media.

2. The method claimed in claim 1, wherein the first volume of the first ink droplet is less than the second volume of the second ink droplet.

3. The method claimed in claim 1, wherein the first volume of the first ink droplet is greater than the second volume of the second ink droplet.

4. The method claimed in claim 1, further comprising the step of applying heat to the stream of ink.

5. The method claimed in claim 1, further comprising the step of applying asymmetric heating to the plurality of nozzle bores.

6. The method claimed in claim 1, further comprising the step of providing an asymmetric structure in spatial relationship with the plurality of nozzle bores to form an asymmetric ink supply channel.

7. The method claimed in claim 1, further comprising the step of providing an ink manifold obstruction for directing the stream of ink into the perpendicular strike position relative to the print media.

8. The method claimed in claim 1, further comprising the step of providing a gas flow for directing either the first ink droplet or the second ink droplet substantially perpendicular to the print media.

9. The apparatus of claim 1, wherein the first droplet deflector is a gas flow.

10. The apparatus of claim 1, wherein the second droplet deflector is a gas flow.

11. The apparatus of claim 10 wherein the gas flow is an air flow created by the printhead moving relative to the image receiver.

12. The apparatus claim ed in claim 1, wherein the first droplet deflector, in cooperation with a gas flow, includes an asymmetric physical structure provided proximate to the one or more nozzles for causing the streams of the ink droplets to deviate from a perpendicular plane.

* * * * *